US005184194A

United States Patent [19]

Mosehauer et al.

[11] Patent Number: 5,184,194

[45] Date of Patent: Feb. 2, 1993

[54] CARRIER PARTICLE SCAVENGING DEVICE

[75] Inventors: Michael Mosehauer; Catherine D. Newell; Andrew J. Mauer, all of Rochester, N.Y.

[73] Assignee: Eastman Kodak Company, Rochester, N.Y.

[21] Appl. No.: 783,488

[22] Filed: Oct. 28, 1991

[51] Int. Cl.[5] ..... G03G 21/00

[52] U.S. Cl. ..... 355/297; 355/269; 355/296

[58] Field of Search ..... 355/296, 303, 305, 306, 355/297, 251, 253, 269, 270; 118/657, 658, 652

[56] References Cited

U.S. PATENT DOCUMENTS

| | | | |
|---|---|---|---|
| 4,349,270 | 9/1982 | Wada et al. | 355/303 X |
| 4,552,451 | 11/1985 | Yamazaki et al. | 355/305 |
| 4,647,186 | 3/1987 | Armstrong et al. | 355/296 |
| 4,697,914 | 10/1987 | Hauser | 355/296 X |
| 4,994,863 | 2/1991 | Reynolds | 355/303 |
| 5,047,807 | 9/1991 | Kalyandurg | 355/296 X |

FOREIGN PATENT DOCUMENTS

| | | | |
|---|---|---|---|
| 0046372 | 3/1983 | Japan | 355/305 |
| 0122678 | 6/1986 | Japan . | |

OTHER PUBLICATIONS

Folkins et al., Xerox Disclosure Journal, vol. 13, No. 6, Nov./Dec. 1988.

*Primary Examiner*—A. T. Grimley
*Assistant Examiner*—Robert Beatty
*Attorney, Agent, or Firm*—Tallam I. Nguti

[57] ABSTRACT

A scavenging device for recapturing charged carrier particles from a moving image-bearing surface includes a first pickup member and a second pickup member. The first pickup member is mounted adjacent toner and carrier particles on the image-bearing member, and is biased electrically to a polarity relatively opposite to the polarity of the charged carrier particles. The second pickup member is also mounted adjacent toner and carrier particles on the image-bearing member to be effective at a point downstream of the first pickup member. The second member, as such, is electrically grounded for capturing from the image-bearing member wrong sign carrier particles.

9 Claims, 4 Drawing Sheets

CARRIER PARTICLE SCAVENGING DEVICE

BACKGROUND OF THE INVENTION

1. Field of the Invention

The present invention relates to electrostatographic reproduction machines such as copiers and printers, and more particularly to a device for scavenging charged carrier particles from an image-bearing surface of such a copier or printer.

Electrostatographic process machines such as copiers and printers are well known for producing or reproducing toned images on selected substrates by employing electrostatic charges and toner particles on an image-bearing surface (IBS) such as a photoconductive surface. Typically, such machines operate through a sequence of currently well known electrostatographic process steps. In copier or printer type machines, for example, these steps include (1) charging of an insulated photoconductive surface with electrostatic charges, (2) forming a latent image electrostatically on such surface by selectively discharging areas on such surface, (3) developing the electrostatic image so formed with particles of toner contained in developer material, (4) transferring the toned image to a suitable receiver sheet for fusing thereon by a fusing apparatus to form a hard copy, and (5) cleaning the photoconductive surface by removing residual toner and/or other particles therefrom in preparation for similarly reusing such surface to produce another such image.

Unfortunately, as is well known, charged carrier particles contained in multiple component developer material undesirably also transfer along with the toner particles and are attracted onto the latent image area of the image bearing surface during the development step. Unlike toner particles which are fusible, such carrier particles are not fusible, and hence when transported through the fusing step, end up creating image defects such as black spots, image voids and halftones.

2. Description Relative to the Prior Art

Apparatus for attempting to scavenge or remove such carrier particles from the developed toner image prior to the fusing step are disclosed for example in U.S. Pat. No. 4,918,488 issued Apr. 17, 1990 to Creveling et al; U.S. Pat. No. 3,543,720 issued Dec. 1, 1970 to Drexler et al; and U.S. Pat. No. 3,457,900 issued Jul. 29, 1969 also to Drexler et al. Such disclosed scavenging apparatus or devices typically include a pickup surface area thereof onto which the charged carrier particles are attracted from the image-bearing surface of their host copier or printer. Where the means of such attraction is electrical biasing, it has been found for example: a) that the voltage across the image-bearing surface is significantly non-uniform and can vary between 30–40 volts within a short time interval, and (b) that an electrically and appropriately biased pickup surface area undesirably may actually recharge and hence reverse the polarity of attracted carrier particles thereby causing such particles with the reversed or wrong sign polarity to be re-attracted onto the image-bearing surface of the copier or printer where they once again are likely to cause image defects as discussed above.

SUMMARY OF THE INVENTION

It is therefore an object of the present invention to provide a scavenging device for effectively capturing charged carrier particles from an image-bearing surface of an electrostatographic reproduction machine such as a copier or printer without disadvantages from any non-uniformity of the voltage of the image-bearing surface.

It is also an object of the present invention to provide a scavenging device that effectively recaptures even reversed or wrong sign polarity carrier particles from an image-bearing surface of an electrostatographic reproduction machine such as a copier or printer.

In accordance with the present invention such a scavenging device comprises (a) a first pickup member for capturing from a moving image-bearing surface charged carrier particles having a correct first polarity, and (b) a first electrical potential source for biasing the first pickup member to a polarity relatively opposite to the correct first polarity. The scavenging device further comprises a second pickup member effective at a point downstream of the first pickup member relative to the movement of the image-bearing surface for recapturing from the image-bearing surface wrong sign carrier particles, and a second electrical potential source, that has a polarity relatively the same as the correct first polarity, for biasing the second pickup member.

In another aspect of the present invention, a scavenging device that includes an electrically biased surface for capturing charged carrier particles from a photoconductive image-bearing surface in an electrostatographic reproduction machine such as a copier or printer, includes an auxiliary erase lamp for reducing the level of charge holding such carrier particles onto the photoconductive image-bearing surface.

BRIEF DESCRIPTION OF THE DRAWINGS

In the detailed description of the invention presented below, reference is made to the accompanying drawings in which like numerals refer to like elements and, in which.

DETAILED DESCRIPTION OF THE PREFERRED EMBODIMENT

Because electrostatographic reproduction apparatus or machines are well known, the present description will be directed in particular to elements forming part of or cooperating more directly with the present invention. Elements not specifically shown or described herein are selectable from those known in the prior art.

Figure 1:
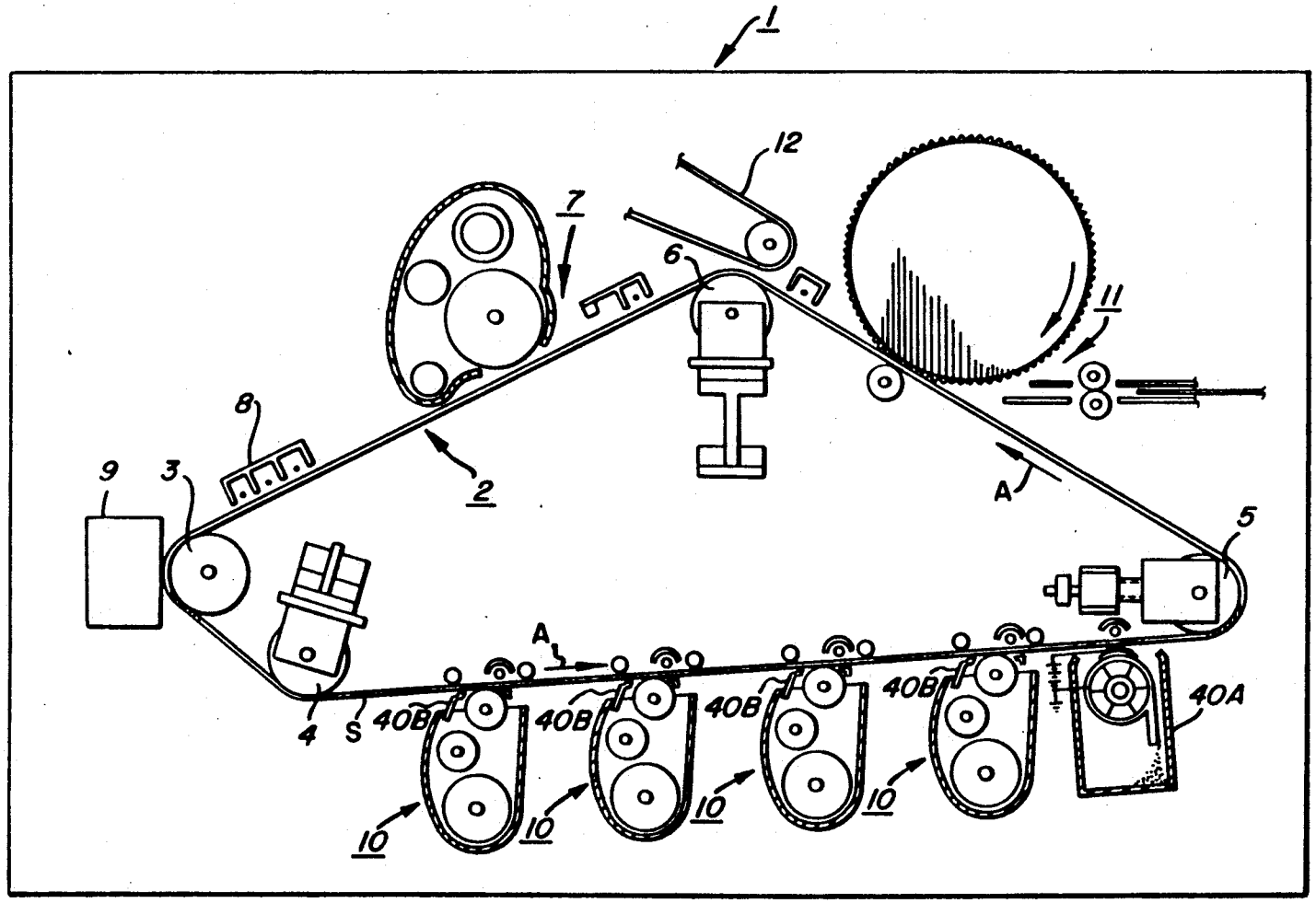
FIG. 1 is a schematic view of an electrostatographic reproduction apparatus such as a copier or printer including the development apparatus of the present invention.

Referring now to the accompanying drawings, FIG. 1 shows an electrostatographic reproduction apparatus such as a printer 1. The apparatus 1 can, of course, also be a copier/duplicator. As shown, the apparatus 1 includes an endless image-bearing member or photoconductive film 2 that is trained for movement in the direction of the arrow A about a series of rollers 3, 4, 5 and 6, one of which is a drive roller.

As is well known, copies of original documents and/or prints of documents can be produced on the printer or copier 1 according to the electrostatographic process. For such process, portions of the moving image-bearing surface S of the image-bearing member 2, are each (a) cleaned at a cleaning station 7, (b) uniformly charged at a charging station 8, and (c) then imagewise exposed at an exposure station 9. The exposure station 9 is shown as an electronic printhead, but can equally consist of optical means.

Imagewise charge patterns or latent images formed at the exposure station 9 are next developed with charged toner particles contained in developer material at a development station or apparatus designated generally as 10. The developer material, for example, can consist of fusible charged toner particles and of non-fusible charged carrier particles. During such development, the charged toner particles are attracted to the latent image on the image-bearing surface. Unfortunately, however, some of the non-fusible carrier particles are also attracted along with the toner particles onto the surface S. A plurality of the development apparatus 10 is shown and, as such, can be used in producing multiple-color copier or prints.

The toner developed image next moves towards a transfer station 11 where it is transferred to a suitable receiver sheet. The receiver sheet thereafter can be separated from the image-bearing member 2, and then transported to a fusing apparatus, not shown, by transport means shown as 12. However, in order to ensure the quality of the fused image, the non-fusible carrier particles or DPU (developer pickup) particles which undesirably are also attracted to the toner image must be removed or recaptured from the toner image prior to the toner image reaching the fusing station. Accordingly, the present invention includes a scavenging device shown generally as 40A, 40B, where 40A is a first embodiment suitable for use externally to and downstream of a development apparatus 10, and 40B is a second embodiment for use internally within a development apparatus 10.

Figure 2:
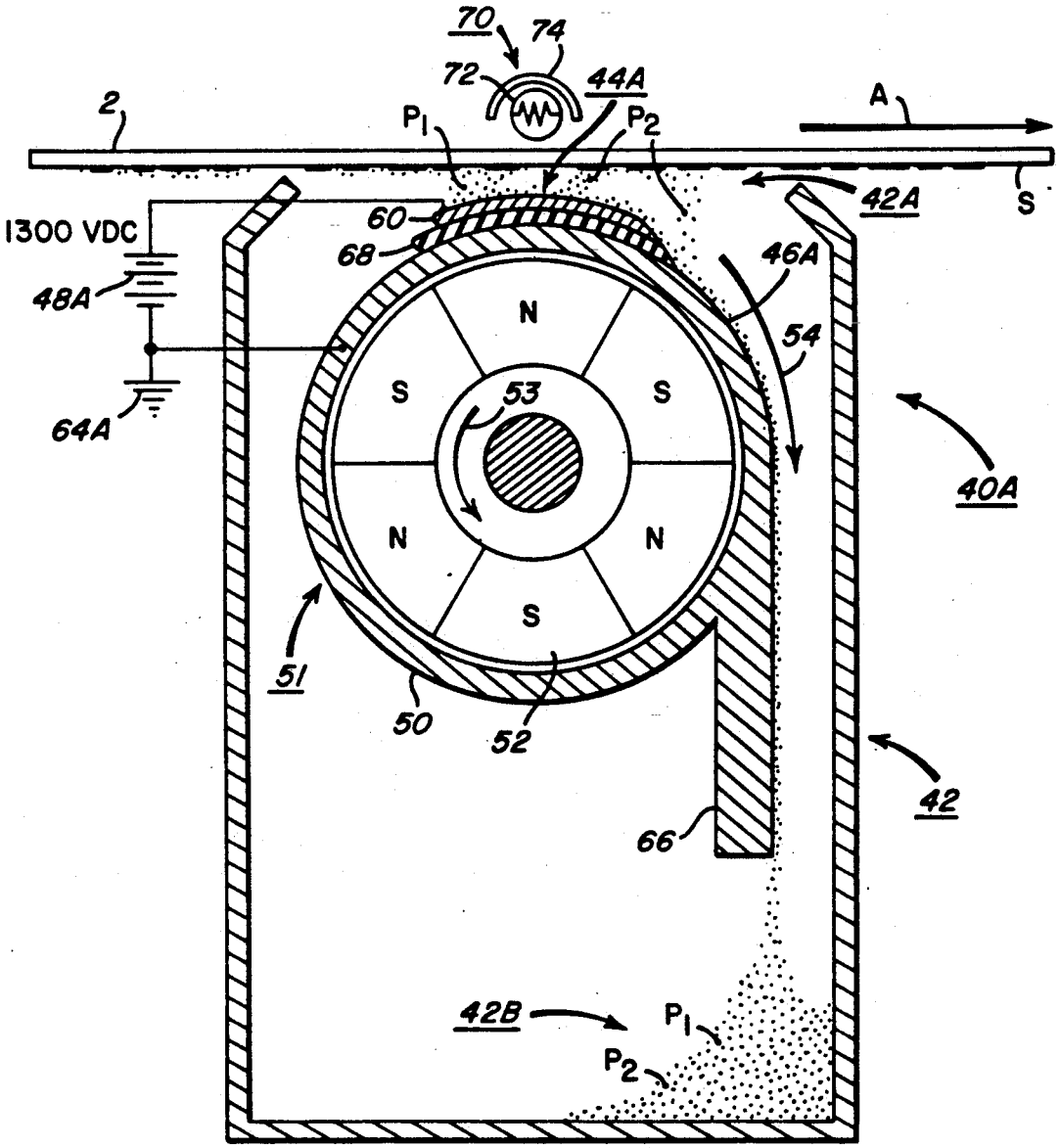
FIG. 2 is a first embodiment of the scavenging device of the present invention.

Referring now to FIG. 2, the first embodiment 40A of the scavenging device of the present invention is shown mounted downstream of a development apparatus 10 adjacent a photoconductive image-carrying surface S in the copier or printer 1. As shown, the device 40A comprises a housing 42, a first conductive carrier particle pickup member 44A, and a second conductive carrier particle pickup member 46A supported within the housing 42. The image-bearing surface S of the image-bearing member 2, for example, is moving in the direction of the arrow A. Housing 42 has an opening 42A for mounting adjacent the surface S, and a sump portion 42B for holding unwanted carrier or DPU particles removed from the surface S. The first pickup member 44A is supported within the opening 42A and is biased suitably for capturing from the surface S unwanted charged magnetic carrier particles $P_1$ which have a correct first polarity, for example, a negative polarity. A correct first polarity is the polarity of charged carrier particles as they are formed in the charged developer material of the development apparatus 10. Such a correct first polarity, as is well known, is usually relatively opposite to the polarity of the toner particles of such developer material. As shown, the scavenging device embodiment 40A includes a first electrical potential source 48A, for example a positive 1300 DC voltage source, for electrically biasing the first pickup member 44A to a correct second polarity, for example a positive polarity. In order to ensure electrostatic attraction of the particles P , this correct second polarity should, as stated for example, be opposite to the first correct polarity of the charged particles P1 being captured from the surface S.

As further shown, the first pickup member 44A is electrically conductive, and may, for example, be a plate 60 of stainless steel or copper. The plate 60 should be at least as long as the cross-track dimension of the imaging area of the image-bearing surface S. Plate 60, however, need not be very wide but should be wide enough to allow sufficient DPU particle recapture time at a particular given speed for the image-bearing member 2. Negatively charged or correct polarity particles $P_1$ for example, are thus attracted from the surface S to the positively charged (1300 VDC) plate 60.

Unfortunately, however, the first correct polarity of some of the carrier particles $P_1$ captured onto the first pickup member 44A, as such, is reversed to a wrong and opposite polarity due to the influence of the biasing source 48A. For example, carrier particles having a negative first correct polarity when captured onto the first pickup member 44A which is biased to +1300 volts, experience a polarity reversal from negative to positive. As a consequence of such a polarity reversal, such carrier particles shown as $P_2$ are repelled back to relatively oppositely charged areas of the surface S by the similarly charged pickup member 44A. The repulsion of these reversed or wrong sign carrier particles $P_2$ from the first pickup member 44A to the surface S occurs because the surface S, in general, is usually at a lower, for example, positive potential than the first pickup member 44A. Such carrier particles $P_2$ on the image-bearing surface S are as likely as the particles $P_1$ to cause image quality defects if not effectively captured and removed from such surface prior to image transfer and fusing.

Accordingly in the present invention, the scavenging device embodiment 40A further includes the second pickup member 46A for recapturing such particles $P_2$ from the surface S. As shown, second pickup member 46A is supported so as to be effective for recapturing the wrong sign particles $P_2$ at a position downstream of an effective pickup position of the first pickup member 44A. The second pickup member 46A is electrically conductive, for example, a metallic non-magnetic shell 50 of a magnetic roller 51 which has a magnetic core 52. As shown the magnetic roller 51 is supported within the housing 42 so as to lie partially adjacent the opening 42A.

The scavenging device embodiment 40A also includes a second electrical potential source 64A for appropriately biasing the second pickup member 46A so that it can electrostatically attract and recapture the wrong sign carrier particles $P_2$ from the surface S. Accordingly, the source 64A should have a polarity that is relatively opposite such wrong sign polarity. As such, the polarity of the source 64A should be relatively opposite the polarity of the first potential source 48A, and hence opposite that of the first pickup member 44A. For example, where the potential of the source 48A is +1300 volts with a positive polarity as shown, a ground potential has been found to be very effective as the source 64A. As such, positively charged (wrong sign) carrier particles $P_2$ retransferring undesirably from the positively biased first member 44A to the surface S thus see the grounded second pickup member 46A as being relatively negative, and are thus re-attracted onto such second member 46A and away from the surface S.

Still referring to FIG. 2, the core 52 of the magnetic roller 51 consists of a plurality of alternating N-S pole magnets. As is well known, the effect of rotating such a core 52 in the counterclockwise direction of the arrow 53 as shown will be to cause magnetic particles, for example DPU particles $P_1$, $P_2$ on the shell 50, to move in the opposite or clockwise direction shown by the arrow 54. The shell 50 preferably is stationary, and consists of a metallic, for example, an aluminum extrusion that includes a hollow cylindrical portion within which the core 52 is mounted as shown, and a tangentially extending straight portion 66. The shell 50 is mounted such that DPU particles $P_2$ recaptured from the surface S will eventually move gravitationally over the portion 66 to a point outside of the magnetic influence of the core 52. At such point, the particles $P_2$ will then drop off the portion 66 and into the sump portion 42B of the housing 42. The portion 66 should therefore be sufficiently wide so as to project from the cylindrical portion to such a point beyond the effect of the magnetic core 52.

As shown, the first pickup member 44A consisting of the narrow plate 60 can be supported on, and electrically insulated from, the stationary shell 50 by means of a pad 68 of electrical insulation. The pad 68 also serves to space the first pickup member 44A biased as shown from the grounded shell 50. The spacing and hence thickness of the insulator pad 68 should be such that the first pickup member 44A lies within the magnetic influence of the core 52, and should preferably be within the range of 0.080" to 0.120". The overall effective spacing range is 0.030" to 0.250", however, electrical arcing can occur if the conductive plate 60 (member 44A) is brought too close to the biased shell 50 (member 46A). The plate 60 of first member 44A is supported on the shell 50 so that it lies within the opening 42A at an area that is upstream of the effective pickup point of the particles $P_2$ by the shell 50, relative to the movement of the surface S. As such, charged magnetic carrier particles $P_1$ are captured onto the plate 60 within the magnetic influence of rotating magnetic core 52, and hence are caused to also move in the direction of the arrow 54 as shown, initially in essentially the same direction with the moving image-carrying surface S, and then downwards away from such surface onto the shell 50 and then with the particles $P_2$ into the sump 42B as described above.

Furthermore, in accordance with the present invention, the scavenging device embodiment 40A includes an auxiliary erase lamp 70 for exposing the photoconductive image-bearing member 2, for example from the back of the member 2. Such exposure as is well known has the effect of reducing the level of charge holding developer material particles, including the carrier particles $P_1$ and $P_2$, on the surface S. The reduction of such charge loosens the particles $P_1$ and $P_2$ and aids their recapture electrostatically by the biased pickup members 44A and 46A. This is because one of the factors affecting the effectiveness, for example, of the first pickup member, biased at +1300 volts potential, is the difference between this higher potential and the lower potential of the surface S. Unfortunately, it has been found that the potential of the surface S, usually referred to as $V_o$ can vary significantly, for example, by as much as 30 to 40 volts, across the surface S within a relatively short period. Use of the auxiliary lamp 70 effectively reduces such high surface potentials thereby increasing the difference between the higher potential of the pickup member, for example the member 44A, and that of the surface S. As shown, the auxiliary erase lamp 70 comprises a filament 72 and a reflector 74. The lamp 70, as such, can be mounted across from the first pickup member 44A and to the back side of the photoconductive member 2.

Figure 3:
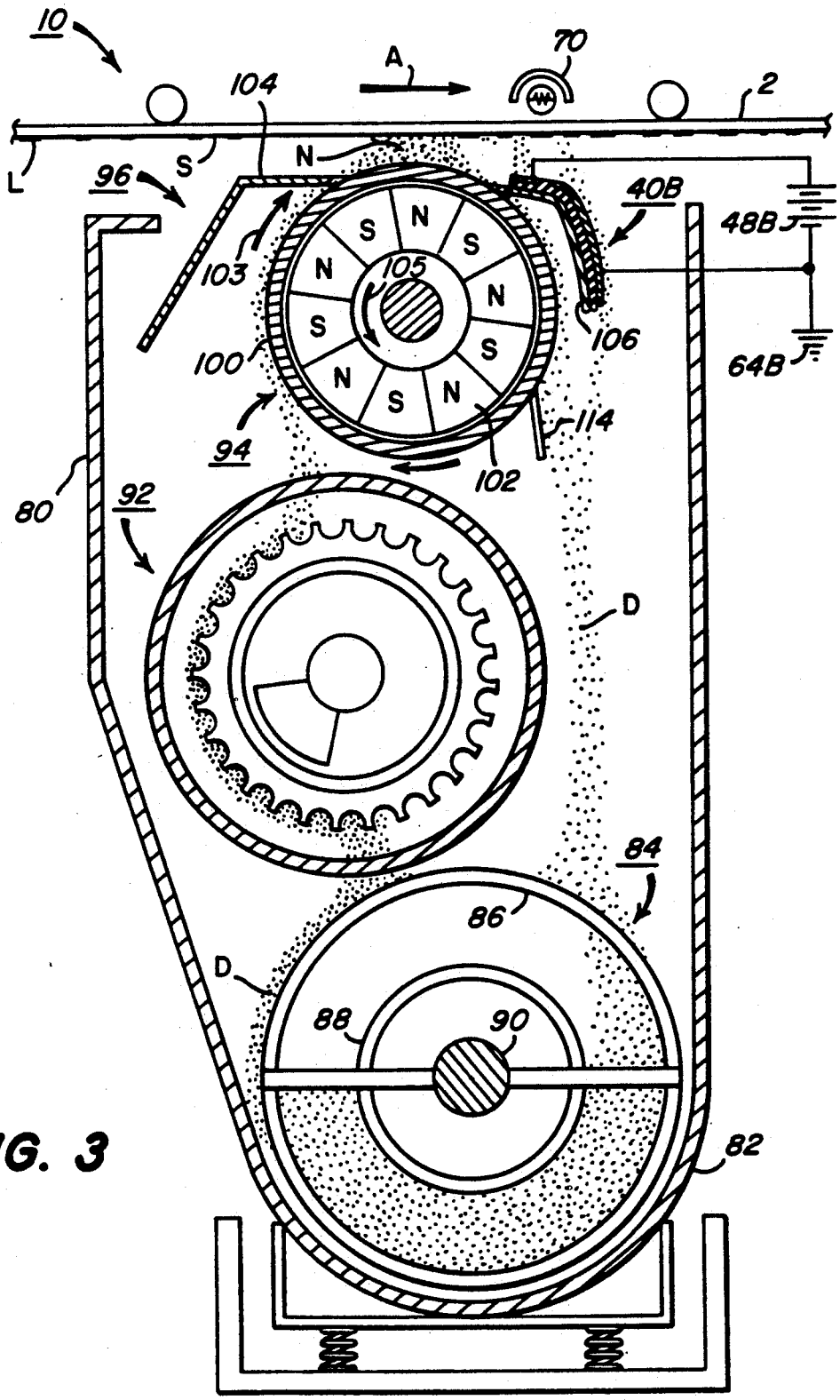
FIG. 3 is a second embodiment of the scavenging device of the present invention employed internally in the development apparatus of FIG. 1.
Figure 4:
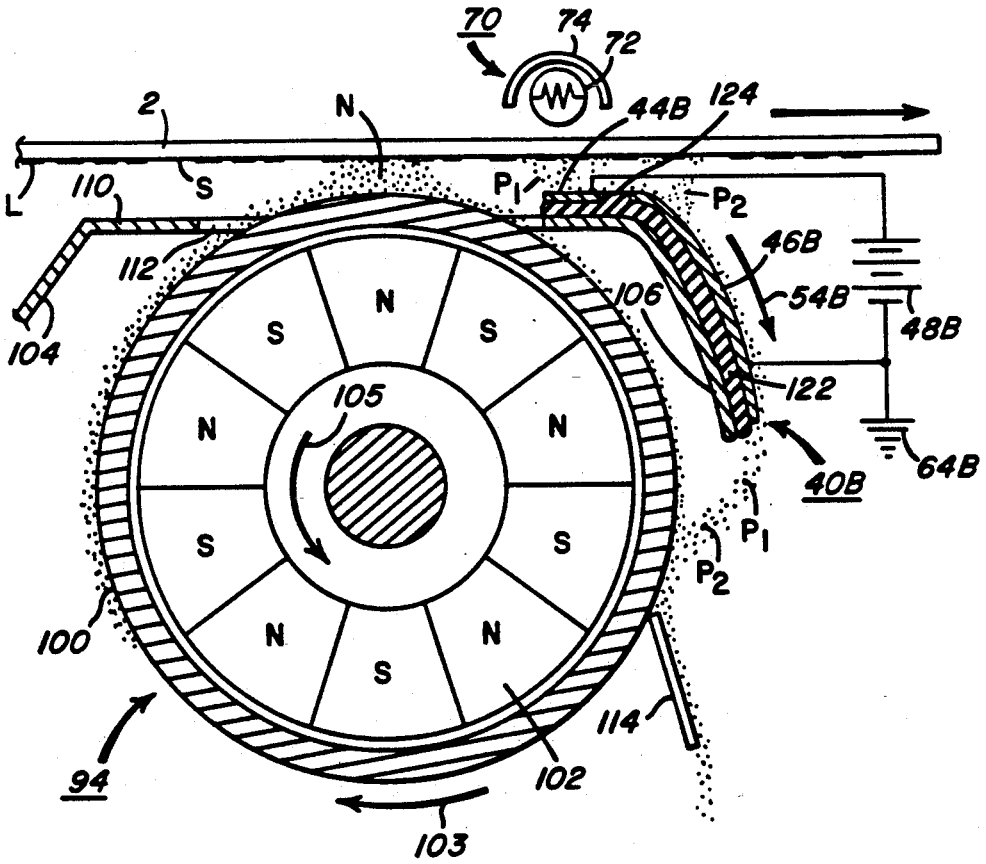
FIG. 4 is an enlarged view of the second embodiment scavenging device of FIG. 3.
Figure 5:
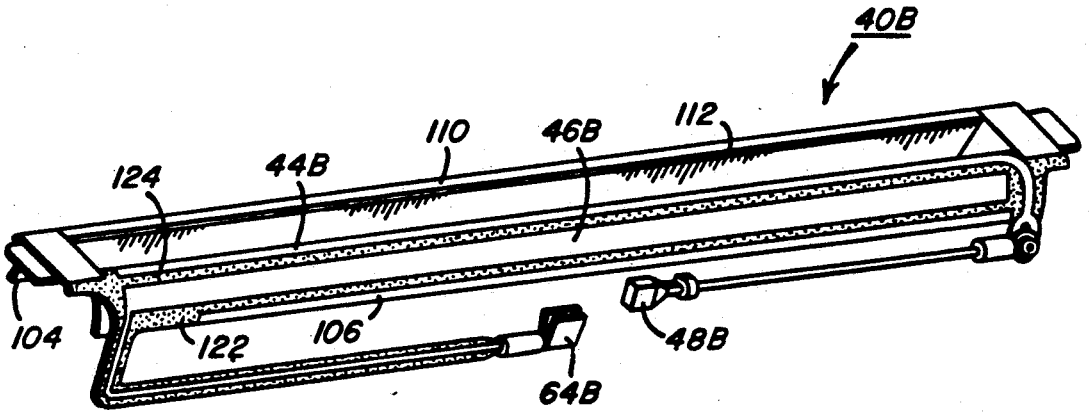
FIG. 5 is a perspective view of the second embodiment scavenging device of FIG. 3.

Referring now to FIGS. 3-5, the second embodiment 40B of the scavenging device of the present invention is illustrated as an internal scavenger within a development apparatus 10 (FIGS. 3 and 4).

Referring now to FIG. 3, one of the development apparatus 10 of the present invention is shown. The apparatus 10 is a magnetic roller-type development apparatus, and is mountable in the electrostatographic copier or printer I. As described above, the photoconductive image-bearing member 2 of the printer 1 is movable in the direction, for example, of the arrow A relative to the development apparatus 10. The apparatus 10 is adapted to supply developer material D, containing charged carrier and marking or toner particles for developing latent charge images L on the image-bearing surface S of the member 2. The latent images L may be composed, for example, of negative charges laid down at the charging station 8.

The development apparatus 10 comprises a housing 80 having a sump portion 82 for holding a supply of the developer material D. Developer material D consists, for example, of small hard magnetic carrier particles an of fusible marking or toner particles. The carrier and toner particles are chargeable triboelectrically by means of a rotatable ribbon blender 84 mounted in the sump portion 82. When the images L are negatively charged, the carrier particles, for example, will be charged negatively, and the toner particles positively.

The ribbon blender 84 may comprise an outer helical ribbon 86 and an inner helical ribbon 88. Both inner and outer ribbons are coiled concentrically about, and movable by a driven shaft 90. Movement of the ribbons 86 and 88 agitates the carrier and toner particles as well as moves them for delivery to a feed mechanism shown as 92. The feed mechanism 92 is located between the ribbon blender 86 and a magnetic brush or roller development means 94. Feed mechanism 92 as located, receives and feeds the charged carrier and toner particles to the magnetic development roller 94 which is located at the top of the housing 80 within an opening 96 therein.

The roller 94 may be of any suitable construction, and may, for example, include a non-magnetic shell 100 and a magnetic core 102 as shown in FIG. 3. The shell 100 may be rotatable in a clockwise direction as shown by the arrow 103 about the core 102. The core 102 consists of a plurality of permanent magnets which are arranged in an alternating N-S pole pattern, and which can be rotated, for example, in a counterclockwise direction as shown by the arrow 105.

Referring to FIGS. 3 and 4, an enlarged portion of the development roller 94 of FIG. 3 is shown in FIG. 4. As mounted within the housing 80, the roller 94 projects through the opening 96 in the top of the housing 80 such that when the apparatus 10 is properly mounted in a copier or printer 1, the projecting portion of the roller 94 will lie directly adjacent, or within a desired proximity to the latent images L. The proximity should be such that toner particles will be transferred to the latent images L when developer material D consisting for example of negatively-charged carrier particles and positively-charged toner particles is transported on the magnetic roller 94 past such images L on the surface S.

Such development occurs within a region or development nip indicated, for example, as N. The region N should lie centrally within the opening 96, FIGS. 3 and 4. During such development, the transfer of charged toner particles from the developer material D to the images L on the surface S as described above is desirable. Unfortunately, however, some of the carrier particles (referred to as DPU or developer pickup particles) undesirably also transfer to the surface S. This undesirable transfer of carrier particles is particularly significant when the carrier particles consist of small, hard and unfusible magnetic particles. In copiers and printers, DPU particles, in general, will result in finished image defects if left on the image-bearing surface and subsequently transferred to a copy sheet or receiver.

Accordingly, the development apparatus 10 includes a scavenging device embodiment of the present invention shown generally as 40B for capturing such DPU particles from the surface S. The scavenging device embodiment 40B comprises a first non-magnetic plate 104, and a second non-magnetic plate 106. As shown, the first plate 104 includes a first portion which is angled relative to the top of the housing 80 and relative to the opening 96 therein, and a second portion 110 which is parallel to the plane of the image-bearing surface S. The plate 104, as such, is mounted by suitable means to the front and rear end walls (not shown) of the development apparatus housing 80 such that the second portion 110 thereof will lie, spaced a small desired distance from the image-bearing surface S.

The second portion 110 of the first plate 104 includes a development aperture 112, and lies within the opening 96. The development aperture 112 therein therefore lies within, and is smaller than the opening 96. Preferably, the width of the aperture 112 should substantially be coincident with the width of the development nip N. As such, developer material D transported by the magnetic development roller 94, when moved through the opening 96, will also be moved through the aperture 112, and so will come into an image development or toner particle-transfer relationship the images L within the nip N as described above.

Referring now to FIGS. 4 and 5, the second embodiment scavenging device 40B of the present invention further includes a first pickup member 44B, and a second pickup member 46B supported within the opening 96 and within the magnetic influence of the magnetic core 102 for recapturing correct as well as wrong sign DPU particles from the surface S. First and second pickup members 44B and 46B are electronically conductive and may, for example, consist of thin copper plates. As shown, these members or plates 44B, 46B are each as long as the cross-track dimension of the imaging area of the surface S, and are mounted on and spaced from the second plate 106 by an electrically insulating pad 122. As further shown, the insulating pad 122 includes a projecting portion 124 which effectively spaces and insulates the second pickup member 46B from the first pickup member 44B. The pickup members or plates (44B and 46B) are formed such that when insulated and spaced from the plate 106, the members 44B, 46B will still lie within the magnetic field of the core 102, and such that the projecting portion 124 of insulating pad 122 forms a smooth outer surface with such plate members 44B and 46B.

The first pickup member 44B as shown is biased suitably for capturing from the surface S charged magnetic carrier particles $P_1$ which have a correct first polarity, for example, a negative polarity. A correct first polarity is the polarity of charged carrier particles as they are formed in the charged developer material of the development apparatus 10. Such a correct first polarity, as is well known, is usually relatively opposite to the polarity of the toner particles of such developer material. For such biasing, the scavenging device embodiment 40B includes a first electrical potential source 48B, for example a positive 1300 DC voltage source, for electrically biasing such member 44B to a correct second polarity, for example a positive polarity. In order to ensure electrostatic attraction of the charged particles $P_1$, this correct second polarity should, as stated for example, be opposite to the first correct polarity of such charged particles $P_1$ being captured from the surface S.

Unfortunately, however, the first correct polarity of some of the carrier particles $P_1$ captured onto the first pickup member 44B is reversed to a wrong and opposite polarity due to the influence of the biasing source 48B. For example, carrier particles having a negative first correct polarity when captured onto the first pickup member 44B biased to +1300 volts experience a polarity reversal from negative to positive as explained above. As a consequence of such a polarity reversal, such carrier particles shown as $P_2$ are repelled back to the relatively oppositely charged areas of the surface S by the similarly charged pickup member 44B. Such carrier particles $P_2$ on the image-bearing surface S are also as likely as the particles $P_1$ to cause image quality defects if not effectively captured and removed from such surface prior to image transfer and fusing.

Accordingly in the present invention, the scavenging device embodiment 40B further includes the second pickup member 46B which is biased appropriately for recapturing such particles $P_2$ from the surface S. As shown, second pickup member 46B is supported so as to be effective for recapturing the wrong sign particles $P_2$ within the opening 96, and at a position downstream of an effective pickup position of the first pickup member 44B. For such biasing, the scavenging device embodiment 40B includes a second electrical potential source 64B connected to the second pickup member 46B for electrostatically attracting and recapturing the wrong sign carrier particles $P_2$ from the surface S. Accordingly, the source 64B should have a polarity that is relatively opposite such wrong sign polarity. As such, the polarity of the source 64B should be relatively opposite the polarity of the first potential source 48B, and hence that of the first pickup member 44B of the embodiment 40B. As above, where the potential of the source 48B is +1300 volts with a positive polarity as shown, a ground potential, for example, has been found to be very effective as the source 64B. As such, positively charged (wrong sign) carrier particles $P_2$ retransferring undesirably from the positively biased first member 44B to the surface S thus see the grounded second pickup member 46B as being relatively negative, and are thus re-attracted onto such second member 46B and away from the surface S.

Still referring to FIGS. 4 and 5, because the core 102 of the magnetic roller 94 consists of a plurality of alternating N-S pole magnets, rotating such a core 102 in the counterclockwise direction as shown by the arrow 105 will cause magnetic particles, for example DPU particles $P_1$, $P_2$ on the surfaces of members 44B, 124 and 46B to move in the opposite or clockwise direction shown by the arrow 54B. The assembly of members 106, 122, 44B and 46B is stationary, and is mounted such that DPU particles $P_1$, $P_2$ recaptured from the surface S will eventually move thereover under the magnetic influence of the core 102 as shown by the arrow 54B initially in essentially the same direction with the moving image-carrying surface S, and then downwards away from such surface back onto the surface of the shell 100 for subsequent return, as removed by a skive 114, to the sump portion 82 (FIG. 3).

Referring to FIGS. 3 to 5, the spacing, and hence the thickness of the projection portion 124 of insulator pad 122 should preferably be within the range of 0.080" to 0.120". An overall spacing range of 0.030" to 0.250" however is effective. Such spacing is necessary to prevent electrical arcing which can occur if the first member 44B biased as shown is supported too closely to the grounded second member 46B.

Furthermore, in accordance with the present invention, the scavenging device embodiment 40B also includes an auxiliary erase lamp 70 for exposing the photoconductive image-bearing member 2. Such exposure has the effect of reducing the level of charge holding developer material particles including the carrier particles $P_1$ and $P_2$ on the surface S. The reduction of such charge loosens the particles $P_1$ and $P_2$ and aids their recapture electrostatically by the biased pickup members 44B and 46B. As explained above, use of the auxiliary lamp 70 effectively reduces high variability in the surface potentials across the surface S thereby increasing the difference between the higher potential of the pickup member, for example the member 44B, and that of the surface S. As shown, the auxiliary erase lamp 70 comprises a filament 72 and a reflector 74. The lamp 70, as such, can be mounted across the first pickup member 44A to the back of the photoconductive member 2.

The invention has been described in detail with particular reference to a presently preferred embodiment, but it will be understood that variations and modifications can be effected within the spirit and scope of the invention.

What is claimed is:

1. A scavenging device for use in an electrostatographic reproduction machine to recapture charged carrier particles from a moving image-carrying surface, the scavenging device comprising:

(a) a first means including a plate member mounted on a non-magnetic shell and within a magnetic field of a magnetic roller core of said non-magnetic shell for capturing from an image-carrying surface charged carrier particles having a correct first polarity;

(b) a second means located downstream of said first means relative to the direction of movement of the image-carrying surface for recapturing from such surface charged carrier particles having a wrong polarity opposite to said correct first polarity; and (c) transport means for moving the recaptured charged carrier particles away from the image-carrying surface.

2. The scavenging device of claim 1 further comprising an electrically insulative member mounted between said first and said second means.

3. The scavenging device of claim 1 further including an auxiliary erase lamp mounted across said first and said second means and to the backside of the image-carrying surface for reducing the level of charges holding charged particles onto such surface.

4. The scavenging device of claim 1 wherein said second means is spaced a distance within a range of 0.080" to 0.120" from said first means.

5. A scavenging device for use in an electrostatographic reproduction machine to recapture charged carrier particles from a moving image-carrying surface, the scavenging device comprising:

(a) a first pickup means including a first electrical biasing source for capturing from an image-carrying surface charged particles having a correct first polarity;

(b) a second pickup means including a second electrical biasing source for recapturing from the image-carrying surface charged carrier particles having a wrong sign polarity opposite to said correct first polarity, said second pickup means being located downstream of said first pickup means relative to the direction of movement of the image-bearing surface; and (c) means for moving recaptured charged particles from said first pickup means over said second pickup means and away from the image-carrying surface.

6. A magnetic development apparatus for use in an electrostatographic copier or printer employing multiple component developer material, including charged carrier and toner particles, the development apparatus comprising:

(a) a housing including a sump portion;

(b) a rotatable magnetic development roller, located within said housing for moving charged carrier and toner particles into position for toner transfer to latent images on an image-bearing member;

(c) means, located within said housing between said sump portion and said magnetic development roller, for feeding charged carrier and toner particles form said sump portion to said development roller; and (d) a scavenging device for recapturing, from the image-bearing surface, unwanted carrier particles undesirably roller onto the image-bearing surface during toner transfer to the latent images, the scavenging device comprising:

(i) a first pickup means for capturing from the image-bearing surface charged carrier particles $P_1$ having a correct first polarity;

(ii) a second pickup means for recapturing from the image-bearing surface charged carrier particles $P_2$ having a wrong sign polarity opposite to said correct first polarity of the charged carrier particles $P_1$; and (iii) transport means for moving the recaptured charged particles initially in the direction of movement of the image-bearing surface and then away from such surface.

7. A scavenging device usable in a magnetic development apparatus employing developer material including toner particles charged to a correct second polarity, for recapturing charged carrier particles from a moving image-bearing surface of a reproduction apparatus during toner image development, the scavenging device comprising:

(a) a first plate member having a first portion and a second portion thereto, said second portion including a development aperture for enabling image development by allowing charged toner particles contained in developer material to transfer from a development roller to an image-bearing surface;

(b) a second plate member connected to said first plate member downstream of said development aperture;

(c) a first pickup means including said second portion of said first plate member for recapturing from the image-bearing surface carrier particles $P_1$ charged to the second polarity, said second portion of said first plate member being mounted onto and insulated from said second plate member;

(d) first means for electrically biasing said second portion of said first plate member to a polarity opposite to said correct first polarity of the charged carrier particles $P_1$;

(e) a second pickup means including a third plate member mounted downstream of said second portion of said first plate member relative to the movement of the image-bearing surface, said third plate member being mounted, so as to be adjacent toner and carrier particles on the moving image-bearing surface, for recapturing from such surface wrong sign charged carrier particles $P_2$ retransferring onto such surface from said second portion of said first plate member; and (f) an electrical potential source for electrically biasing said third plate member to a polarity relatively the same as said correct second polarity of the carrier particles $P_1$.

8. A method for scavenging charged carrier particles from a developed image on a moving image-bearing surface, the method comprising the steps of:

(a) providing a first pickup means for capturing from the image-bearing surface charged carrier particles having a correct first polarity;

(b) providing a second pickup means, downstream of said first means relative to the direction of movement of the image-bearing surface, for recapturing from the image-bearing surface charged carrier particles having a wrong polarity opposite to said correct first polarity; and (c) transporting the captured and recaptured charged carrier particles from said first means and said second means over said second means in the direction of movement of the image-bearing surface and then away from said surface.

9. The method of claim 8 in which the step of providing the second pickup means includes grounding only said second means.

* * * * *